United States Patent [19]

Komatsu et al.

[11] 4,202,705

[45] May 13, 1980

[54] TREATING BATH, FORMING A MIXED CARBIDE LAYER OF VA-GROUP ELEMENTS ON A FERROUS ALLOY SURFACE AND RESULTING PRODUCT

[75] Inventors: Noboru Komatsu; Tohru Arai, both of Toyoake; Hinonori Fujita, Aichi, all of Japan

[73] Assignee: Kabushiki Kaisha Toyoto Chuo Kenkyusho, Japan

[21] Appl. No.: 921,794

[22] Filed: Jul. 3, 1978

[30] Foreign Application Priority Data

Jun. 30, 1977 [JP] Japan ..... 52-80411

[51] Int. Cl.[2] ..... C23C 9/10

[52] U.S. Cl. ..... 148/6.11; 427/399; 427/431

[58] Field of Search ..... 148/6.11; 427/431, 399

[56] References Cited

U.S. PATENT DOCUMENTS

| | | | |
|---|---|---|---|
| 3,671,297 | 6/1972 | Komatsu et al. | 428/472 X |
| 3,719,518 | 3/1973 | Komatsu et al. | 428/471 X |
| 3,885,059 | 5/1975 | Komatsu et al. | 427/431 X |
| 3,912,827 | 10/1975 | Komatsu et al. | 427/431 X |
| 3,922,405 | 11/1975 | Komatsu et al. | 148/6.11 X |
| 3,930,060 | 12/1975 | Komatsu et al. | 148/6.11 X |

OTHER PUBLICATIONS

Periodic Table of the Elements, Handbook of Chemistry and Physics, 54th Ed. 1973, end paper.

*Primary Examiner*—Ralph S. Kendall

*Attorney, Agent, or Firm*—Berman, Aisenberg & Platt

[57] ABSTRACT

A method and treating material are presented for forming a mixed carbide layer of Va-Group elements on the surface of a carbon-containing ferrous-alloy material. The molten bath is made by introducing one or more oxides of Va-Group elements and one or more metals or alloys of Va-Group elements (other than the elements forming the oxides) into a molten bath composed of boric acid, a borate or a mixture thereof. The mixed carbide layer formed on the surface of the article is very smooth, wear resistant and corrosion resistant.

14 Claims, 5 Drawing Figures

(X400)

TREATING BATH, FORMING A MIXED CARBIDE LAYER OF VA-GROUP ELEMENTS ON A FERROUS ALLOY SURFACE AND RESULTING PRODUCT

BACKGROUND

A ferrous-alloy article on which a vanadium carbide layer or niobium carbide layer is formed has improved corrosion resistance against molten metals and also has improved wear resistance. A niobium carbide layer has better corrosion resistance and better appearance than those of a vanadium carbide layer. However, niobium carbide has some defects. For example, when low-alloy steel is used as base or mother material, a carbide layer (formed with niobium carbide) has a tendency to crack or peel off. It has been found that a ferrous alloy article with a surface on which a layer of mixed carbide of Va-Group elements is formed has imparted to it such features that the article has the merits of both carbide layers of the individual Va-Group elements.

To form a mixed carbide layer on the surface of a ferrous-alloy article, immersing and keeping the ferrous alloy in a molten borate bath, to which powder of the pure metals or alloys of vanadium and niobium are added, has been proposed (Japanese Pat. No. 669,246). This method has remarkable utility, but also has the following defects:

(1) The metal powder (added to the molten borate bath) tends to build up and thus collect at the bottom of the vessel. When an article being treated is immersed in or contacted with the collected metal powder, some metal powder adheres to and thus impairs the smoothness of the surface of the article. Therefore great care must be taken while dipping the article into the bath.

(2) The effective volume in which articles to be treated are introduced is limited and productivity is reduced to a low level due to the first noted defect.

(3) Since collected or built-up metal powder tends to be sintered (particles adhere to each other) in a grain, the total surface area of the powder becomes smaller and the dissolution of carbide-forming elements in borax or borate is reduced. In order to overcome this, particles collected at the bottom part of the vessel must be stirred up from time to time. This necessitates considerable work.

(4) When metal powder contacts the surface of an article being treated, the powder adheres to and mars the surface condition of the article.

(5) A necessarily large amount of metal powders added to a salt bath increases the viscosity of the bath. The amount of treating material which adheres to an article treated in such bath and is taken out of the bath with the treated article increases with increased viscosity.

(6) The increase in viscosity of the salt bath decreases fluid character and reduces convection within the bath; this results in reducing the uniformity in temperature distribution throughout the bath. The effective volume of the bath-containing vessel is thus further limited.

SUMMARY OF THE INVENTION

The present invention has several distinct, but closely interrelated, aspects:

(a) treating bath compositions, (b) molten treating baths, (c) forming a mixed carbide layer of Va-Group elements on the surface of a carbon-containing ferrous-alloy article, and (d) a carbon-containing ferrous-alloy article having a mixed carbide layer of Va-Group elements on its surface.

An article of a ferrous alloy (having at least 0.1 percent by weight of carbon in its composition) is immersed in a molten bath [of molten boric acid, borate or a mixture thereof and comprising (1) one or more oxides of one or more Va-Group elements and (2) one or more Va-Group elements (in metal or alloy form) other than what is incorporated in the bath in oxide form] and maintained therein for a period of time sufficient to form a mixed carbide layer of Va-Group elements on the surface of the article.

OBJECTS

An object of this invention is to provide an improved method for forming a mixed-carbide layer of Va-Group elements on the surface of a ferrous alloy article in a treating molten bath.

Another object of this invention is to provide a method for forming on such article a dense (which means not porous) and uniform mixed-carbide layer without any undissolved treating-metal particles adhered to the surface of the article.

An additional object of this invention is to provide a method for forming a mixed-carbide layer which has excellent wear resistance, corrosion resistance against molten metals, resistance against cracking and resistance against peeling off.

A further object of this invention is to provide a molten treating bath which is capable of forming a mixed-carbide layer (having a smooth surface) on a ferrous-alloy article.

A still further object of this invention is to provide a method for forming a mixed-carbide layer (of Va-Group elements) which has the combined merits of a plurality of single-carbide layers of each of the Va-Group elements.

Other objects include suitable treating bath compositions, molten baths and resulting treated articles.

Additional objects are apparent from the following description.

BRIEF DESCRIPTION OF THE DRAWINGS

FIG. 1 reflects a variaion from 3 to 30 percent of ferro-niobium and from 3 to 30 percent of $V_2O_5$ compounded in a borate bath.

FIG. 2 reflects a variation from 3 to 30 percent of ferro-vanadium and from 3 to 30 percent of $Nb_2O_5$ compounded in a borate bath.

FIG. 3 reflects a variation from 3 to 20 percent of ferro-vanadium and from 3 to 20 percent of $Ta_2O_5$ compounded in a borate bath.

FIG. 4 reflects a variation from 3 to 20 percent of ferro-niobium and from 3 to 20 percent of $Ta_2O_5$ compounded in a borate bath.

DETAILS

Figure 1:
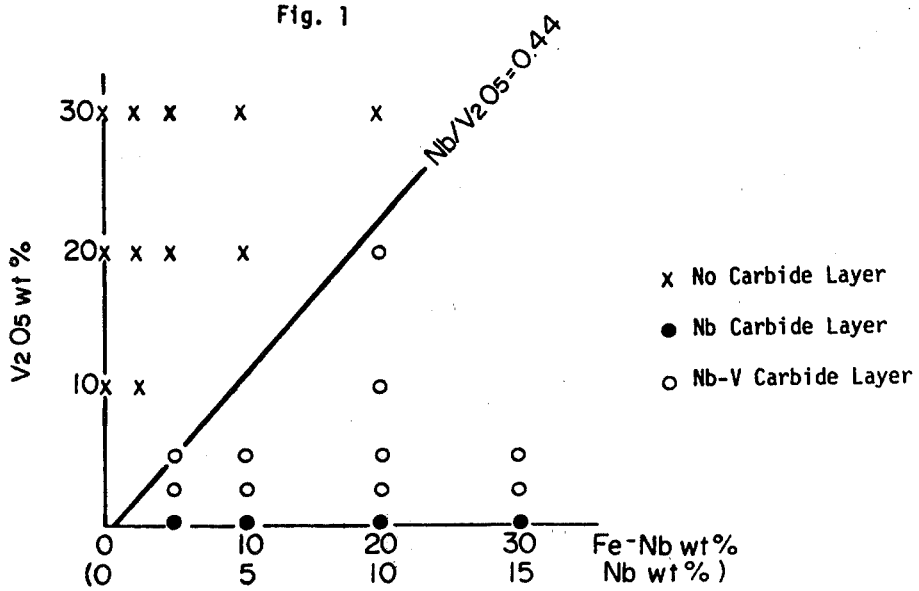
FIGS. 1 to 4 show the existence of a carbide layer corresponding to the kinds and quantities of materials which are compounded in a borate bath.
Figure 2:
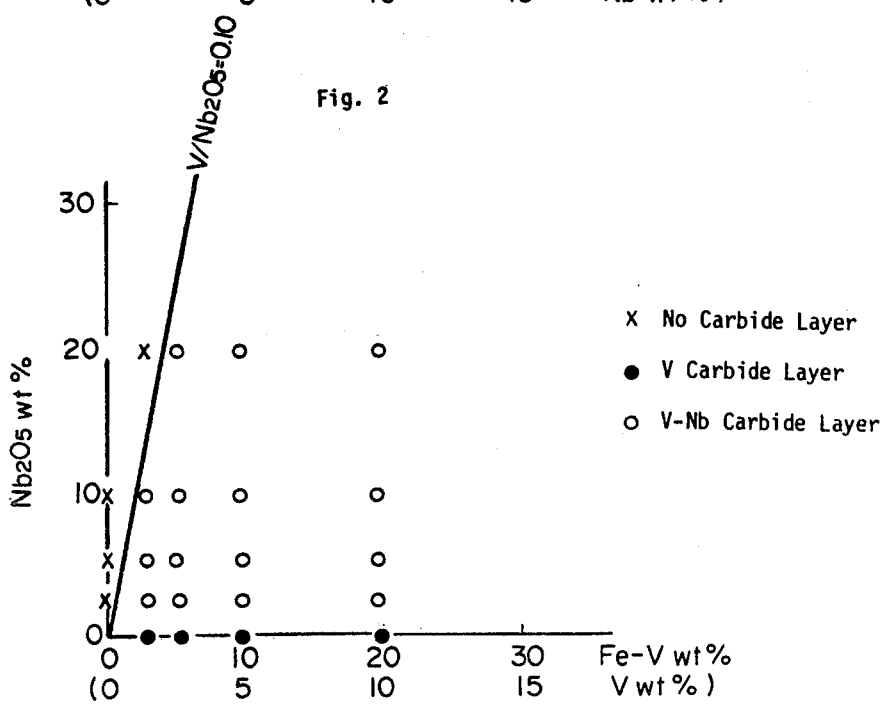
Figure 3:
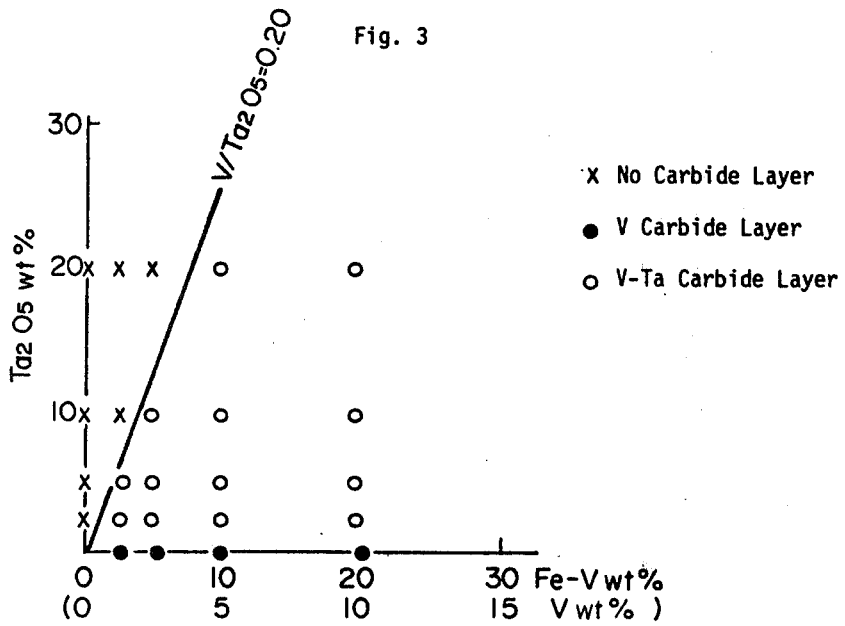
Figure 4:
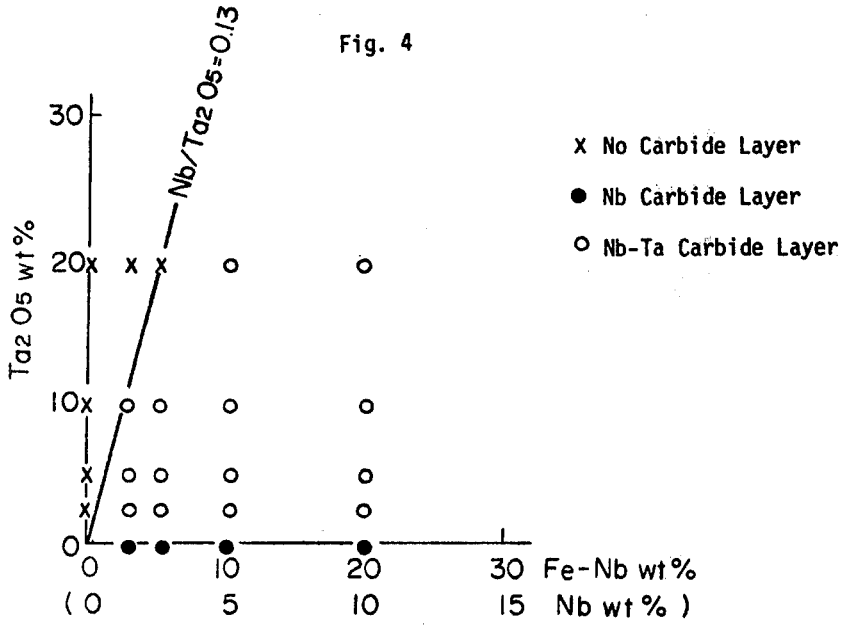

A carbide layer of a Va-Group element, such as vanadium (V), tantalum (Ta) and niobium (Nb), on a surface of a carbon-containing ferrous alloy article imparts to the surface definite properties which depend on the particular Va-Group element. Also, the formation of such a carbide layer is dependent upon a number of factors, including the nature of the ferrous alloy and the requirement that it contain at least 0.10 percent by weight of carbon.

The carbide layer is conveniently formed on such a ferrous-alloy article by immersing the article in a molten borate or boric acid bath containing a Va-Group element in a suitable form. Although oxides of Va-Group elements are soluble in these molten baths, it appears that the free-metal form is needed. However, Va-Group elements in free-metal or alloy form lack the requisite solubility and tend to impair the surface of articles immersed in molten baths containing them.

Dissolving a Va-Group element (in metal or alloy form) in the molten bath is somewhat facilitated by concurrently incorporating in the same bath one or more oxides of the Va-Group element. By having the Va-Group element (in metal or alloy form) as a finely-divided powder (particle size, e.g., from −100 to −325 mesh), solution is further assisted. Mesh is based on Tyler Standard.

Carbide layers of different Va-Group elements impart different advantageous properties, e.g. hardness, smoothness and resistance to corrosion, wear, peeling, cracking and oxidation, to surfaces of ferrous alloys. To obtain a combination of advantageous properties, two or three different Va-Group elements are incorporated in a molten bath to form a suitable treating bath. The Va-Group elements so incorporated are not all initially in the same form. At least one is in metal or alloy form and at least one different Va-Group element is in the form of an oxide. For all combinations of Va-Group elements any one or two are optionally in metal or alloy form and a different one or two are optionally in the form of one or more oxides.

Depending upon which Va-Group element is in metal or alloy form and whether a particular Va-Group element is in oxide form or in metal or alloy form, the relative proportions of Va-Group elements are advantageously varied in the molten treating bath. The weight of Va-Group elements in the form of metal or alloy is suitably at least 10 percent of the total weight of oxide(s) of Va Group elements introduced into the treating bath.

When the Va-Group element is in alloy form, e.g., as ferro-niobium (Fe-Nb) or ferro-vanadium (Fe-V), the weight of niobium in such form is preferably at least 13 percent of the weight of any tantalum oxide (when the only Va-Group element in oxide form is tantalum) and at least 44 percent of the weight of any vanadium oxide (when the only Va-Group element in oxide form is vanadium). Likewise, the weight of vanadium in such alloy form is preferably at least 10 percent of the weight of any niobium oxide (when the only Va-Group element in oxide form is niobium) and at least 20 percent of the weight of any tantalum oxide (when the only Va-Group element in oxide form is tantalum). Here, ferro-alloy such as ferro-niobium means alloys consising essencially of Fe and Nb and can be generally bought as ferro-niobium in a market.

The molten medium for the treating bath is provided by boric acid or a borate or any suitable mixture. Alkali metal borates are conveniently used for this purpose, particularly borax.

When one or more Va-Group elements are introduced into the molten bath, they are generally in particulate, e.g. powder, or flake form. A Va-Group element in metal or alloy form is preferably introduced into a molten bath as a fine powder, i.e. having a particle size finer than 100 mesh.

The main ingredient of the molten treating bath is boric acid, a borate or a mixture thereof. This is essential to, but not the crux of, the instant invention. Although molten borax baths are most practical, corresponding baths based on one or more borates (or such borates in combination with boric acid) are similarly useful.

Essential bath additives include one or more oxides of one or more Va-Group elements and one or more Va-Group metals (or alloys thereof) other than elements in previously-noted oxides. For example, when a vanadium and/or tantalum oxide is used as the oxide, niobium powder or niobium-alloy powder is added to the bath as the metal or alloy. Both two or more oxides and two or more metals or alloys are optionally incorporated in a molten bath.

The weight percent of oxide of Va-Group element(s) in the molten treating bath ranges from about one to about 35 to 40 percent. The weight percent of Va-Group metal or alloy similarly ranges from about one to about 35 to 40 percent. The total of such metal or alloy and such oxide is preferably not more than about 80 percent by weight. Illustrative bath compositions are those in which each of the elements vanadium (V), tantalum (Ta) and niobium (Nb) is in powdered (particle size no larger than 100 mesh) metal form. Rather than powdered metal form, each of V, Ta and Nb is optionally in the form of a powdered alloy (having a corresponding particle size) of such element.

An oxide of a Va-Group element and the metal or alloy of a Va-Group element (other than that of the element in oxide form) are incorporated in the molten bath because a carbide layer cannot be formed by dipping a ferrous-alloy article into such a molten bath containing only an oxide of a Va-Group element. In order to form a carbide layer on a ferrous-alloy article in the molten bath containing only an oxide of a Va-Group element, it is necessary to electrolyze the bath or to add thereto a reducing agent (together with said oxide) in order to separate a carbide-forming element by reducing the oxide.

With regard to the present invention, the metal added together with the oxide reduces the oxide according to the following reaction scheme:

$$2/5V_2O_5+4/5Nb \rightarrow 2/5Nb_2O_5+4/5V \quad (1)$$

The free energy change $\Delta G$ determines whether the reduction reaction advances or not. When the value of $\Delta G$ is minus, the reaction advances and the reduction is carried out. When $\Delta G$ is plus, the reaction does not advance and the reduction is not carried out. It appears that a determination whether a particular reduction reaction advances or not can readily be made without experiment, thus indicating whether a carbide-forming element (or ion) of the present invention is formed and, finally, the prospects of forming a carbide layer of the Va-Group element, i.e. if the $\Delta G$ value can be ascertained from the well-known thermodynamic constant. However, detailed experiments have shown that such an easy estimation based on $\Delta G$ is impossible. (The formation of a carbide layer is based on the production of atoms by reduction. However, the production of the atoms does not always form a carbide layer. The formation of a carbide layer is affected by other factors, such as the created free energy of the carbide and of other substances therewith.)

For example, with regard to the mixed carbide of V and Nb, the combination of an oxide powder of V and the metal powder of Nb makes ΔG of the previously-noted Equation (1) minus. Therefore, the reduced V and the remaining Nb (which is not used for the reduction) are expected to form the mixed carbide. On the other hand, in a bath to which an oxide powder of Nb and metal powder of V are added, ΔG of the reaction is plus.

$$2/5Nb_2O_5+4/5V \rightarrow 2/5V_2O_5+4/5Nb$$

Therefore, it was expected that only a vanadium carbide layer would be formed because the reduction of, e.g., $Nb_2O_5$ would not be effected. However, actual experiments confirm that a mixed-carbide layer of Nb and V is clearly formed. A possible explanation of this phenomenon is that $V_2O_5$ and/or $Nb_2O_5$ might be changed to other types of oxides in the borate bath. At present, the ultimate constitution of the molten salt bath has not been precisely determined scientifically. Therefore, it was not possible to predict whether a mixed-carbide layer could be formed according to instantly-disclosed method. Needless to say, the molten bath composition is readily characterized by its make-up (in terms of constituents and amounts) and its temperature.

The inventors described in patent application Ser. No. 902,696, filed May 4, 1978, the entire disclosure of which is incorporated herein by reference, that added oxide powder is easily dissolved in a molten borate bath. The present invention aims at further promoting dissolution of additives in a molten borate bath by using a carbide-forming element in oxide form and the industrially-preferable formation of a mixed-carbide layer.

Further the addition of an oxide of a Va-Group element remarkably improves the fluidity of the borate bath and overcomes defects, such as an increase in wasted bath material which is removed from the bath by adherence to treated articles, reducing convection by high viscosity and decreasing the effective volume of a vessel by reducing the uniformity in temperature distribution, caused by the exclusive addition of metal powder to the bath. Furthermore, the present invention lengthens the life of the salt bath by making it possible to incorporate more metal powder therein. The improvement in fluidity attained by the addition of oxides may be caused by the ready dissolution of such oxides and also of oxide formed by the reaction of metal powder with added oxide. By the improvement in bath fluidity attained by incorporating oxides therein, the treatment can be advanced in the bath at a low temperature. In this case, the difficulty caused by lowering the fluidity of the bath can be overcome.

By defects caused by incorporating only metal powder in a borate bath a new method in which a reducing agent (for reducing oxides), such as silicon, aluminum, calcium, titanium or manganese, is added together with oxides is employed. However, this method can form a mixed carbide layer but incurs the following defects. It is difficult to control the make-up of the bath because of the complexity of the bath composition, and several further problems are caused by the reducing agent. For example, when ferro-aluminum (Fe-Al) is used as reducing agent, the Fe-Al attaches to the surface of a treated article and impairs the smoothness and contour of such surface. When silicon or calcium is the reducing agent, it takes considerable time to wash treated articles because the borate (including silicon and/or calcium) is not easily dissolved. Also, reducing agents preferentially reduce the oxide which is more reducible than another, and the formed carbide layer is composed mainly of the Va-Group element of the reduced oxide. Therefore, continuous or steady formation of a mixed carbide layer having a predetermined composition is very difficult. A further drawback is that the composition of any formed mixed carbide layer is apt to change with time. The present invention overcomes these defects.

The composition ratios of the oxide powder and of the metal powder of Va-Group elements, which are added into the borate bath according to the present invention, vary over a considerable range according to the kind of oxide and are not properly limited to specific values. The actual component ratios employed should be decided by a trial experiment preceding any industrial run. However, as a general rule, increasing the ratio of the metal powder to the oxide powder increases the ratio of the Va-Group element of the metal powder which is contained in the formed mixed-carbide layer.

FIGS. 1 to 4 show some experimental results. The results were obtained with molten baths in which the main ingredient was borax, the bath temperature was 950° C., the articles to be treated were JIS SK4*, ferro alloys (containing 50 percent of Fe), the metal of Va-Group elements was in the form of powder (−100 mesh), and several kinds of oxide powder (−100 mesh) of Va-Group elements were used. The obtained results confirm that the border lines separating the range in which a mixed-carbide layer is formed and the range in which no carbide layer is formed are dependent upon the kind of oxide, and the border lines obtained with baths containing vanadium oxides are shifted to the side on which the ratio of the metal powder to the oxide powder is large, i.e. compared with the border lines relating to oxides of Ta or Nb.

*JIS SK 4: Japanese Industrial Standard SK 4; Chemical Composition (%) (C: 0.90–1.00 Si: 0.35 or less Mn: 0.50 or less P: 0.030 or less S: 0.030 or less Fe: the rest)

Further, (a) as the particle size of the metal powder increases (b), as the content of carbide-forming element in the metal powder decreases or (c) as the oxygen content of the oxide increases, the border line is shifted to the side on which the ratio of the metal powder to the oxide powder is large. With regard to the particle size for employed powder, metal powders are not easy to dissolve in a molten borate bath. Only elements in the surface portions of the powder are regarded as being subject to reaction. The metal or alloy particle size is preferably finer than 100 mesh. On the other hand, the particle size of the oxide powder is not so critical because the oxide powder is easily dissolved in the molten borate bath. The composition of an article to be treated and the bath temperature also affect the border lines, such as those depicted in FIGS. 1 through 4. However, the effects are changed by other conditions, such as the kind of oxide and the particular metal. Therefore, the effects cannot be determined in the abstract.

With regard to the content of carbide-forming elements included in a mixed-carbide layer, the contant of the element included in the metal powder increases (a) as the particle size of the metal powder decreases, (b) as the content of the carbide-forming element in the metal powder increases or (c) as the content of the carbide forming element in the oxide decreases. Also, the contents are affected by the composition of an article to be treated and the bath temperature. However, such effects cannot be determined in the abstract.

The carbon content of a ferrous alloy article to be treated according to the present invention should be at least 0.10 percent by weight or more. When the carbon content is less than 0.10 percent by weight, the formed mixed-carbide layer is generally too thin, and the object of the present invention is not attained. Also, the carbon content of a ferrous-alloy article greatly affects the forming speed, and the resulting thickness of the obtained mixed-carbide layer. However, the components other than carbon in a ferrous alloy article do not substantially affect the formation of a mixed-carbide layer. The effects of the components of a ferrous-alloy article on the formation of a carbide layer are the same as those obtained by conventional methods using borate as the main bath ingredient for forming a carbide layer.

A desirable mixed-carbide layer is formed on the surface of a ferrous-alloy article (containing 0.10 percent by weight or more carbon) by adding (a) at least one oxide of one or more Va-Group elements (V, Nb, Ta) and (b) metal or alloy powder of one or more Va-Group elements (other than the elements used in oxide form) into a borate bath and dipping the article in the bath at a temperature preferably within the range of from 850° to 1100° C. for a period sufficient to form the desired layer. While the article is kept in the bath, if necessary, the article may be electrolyzed under a low current density at which a boride layer is not formed. The viscosity of the borate bath is ordinarily too high and a uniform mixed-carbide layer is not easily formed at a bath temperature below 850° C., and bath temperatures in excess of 1100° C. tend to yield poorer products because the grains in the mother material grow and toughness becomes lower. The dipping treatment of the present invention is carried out either in an oxygen-free atmosphere or in air.

When, e.g., a mixed carbide layer of V and Nb is to be formed on the surface of an iron-alloy article, a suitable oxide, e.g. one or more oxides, such as $V_2O_5$, $V_2O_3$ and VO, and powder of Nb metal or of Nb alloy (for example Fe-Nb), as the metal or alloy, are incorporated in a borate bath. Or, on the contrary, a corresponding Nb oxide is used as the oxide, and powder of V metal or of a V alloy is employed as the metal or alloy (cf. baths 12 and 30 in Table I). To form a mixed-carbide layer of V and Ta (cf., e.g., baths 1 and 15) or of Nb and Ta (cf., e.g., baths 18 and 20), one of them should be in oxide form and the other should be in metal or alloy form. For the formation of a mixed-carbide layer of V, Nb and Ta, the purpose can be attained by taking an oxide of one or of two of them as the oxide and the metal or alloy of the rest as the metal or alloy (cf., e.g., baths 2 to 11).

The present invention is illustrated by the following examples, which are not in any way intended to limit the scope of the invention. For example, the bath temperature is optionally decreased to, e.g., 900° C. or increased to, e.g., 1050° C., and the specified carbon-steel test pieces are optionally replaced by another ferrous-alloy article containing at least 0.10 percent by weight of carbon to obtain corresponding results. Likewise, boric acid or some other borate optionally replaces those illustrated.

EXAMPLE 1

5 kg of borax were introduced into a crucible made of heat-resistant alloy and heated up to 950° in an electric furnace. Then, 0.33 kg (5 percent of the composition) of $V_2O_5$ particles having a diameter of several mm and 1.4 kg (20 percent of the compositions) of ferro-niobium (Fe-Nb) powder (including about 50 percent of Nb), which was not more than 100 mesh, were added to the borax to prepare a treating bath.

Figure 5:
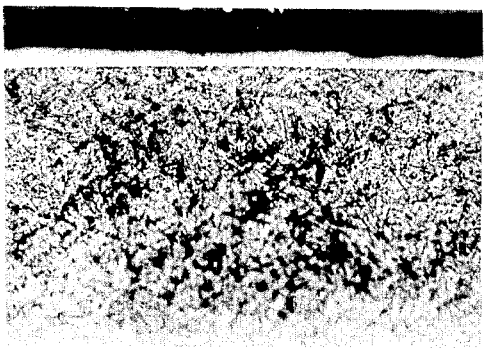
FIG. 5 shows a cross-sectional microphotograph of the surface layer of a treated article.

Next, test pieces made of carbon tool steel (JIS SK4) with a diameter of 8 mm and a length of 50 mm were dipped in the bath, kept there for 4 hours at 950° C. and then taken out of the bath. The test pieces were washed with water after being cooled in air. The test pieces were cut to observe the cross-section of the treated surface layer. The thickness of the layer was measured, and the structure of the layer was analyzed under a microscope, an X-ray microanalyzer and an X-ray diffraction meter. As shown in the microphotograph in FIG. 5, the cross-sectional structure was observed to have one uniform surface layer with a thickness of 9 microns on each surface of test pieces. This surface layer was identified to be (Nb, V)C, i.e. a mixture of niobium and vanadium carbide or, more precisely, a structure of niobium carbide in which some niobium atoms are replaced by vanadium atoms, by X-ray diffraction and was measured by an X-ray microanalyzer to determine that the ratio of Nb to V was about 4 to 1 by weight and that the V was mainly distributed near the mother material in the layer.

EXAMPLE 2

5 kg of borax were introduced into a crucible made of heat-resistant alloy and heated up to 950° C. in an electric furnace. Then 0.17 kg (3 percent of the composition) of $Nb_2O_5$ particles and 0.57 kg (10 percent of the composition) of ferro-vanadium (Fe-V) powder (including about 40 percent of V) which was not more than 100 mesh were added to the borax to prepare a treating bath.

Next, test pieces which had the same form, composition and quality as those used in Example 1 were dipped in the noted bath, kept therein for 4 hours at 950° C. and then taken out of the bath. The test pieces were washed with water after being cooled in air. In the same manner as in Example 1, the structure of the treated test pieces was analyzed by a microscope, an X-ray microanalyzer and an X-ray diffraction meter. The surface layer produced by this Example was observed to have one uniform surface layer which was identified to be (Nb, V)C with a thickness of 8 microns on each testpiece surface. The ratio of Nb to V in this carbide layer was about 1 to 1 by weight.

EXAMPLE 3

5 kg of borax were introduced into a crucible made of heat-resistant alloy and heated up to 950° C. in an electric furnace. Then 1.43 kg (20 percent of the composition) of $Ta_2O_5$ powder (which was not more than 100 mesh) and 0.72 kg of ferro-vanadium (Fe-V) powder (including about 50 percent of V), which was not more than 100 mesh, were added to the borax to prepare a treating bath.

Next, test pieces which had the same form, composition and quality as those used in Example 1 were treated in the same manner as in Example 1.

By this treatment, one uniform surface layer with a thickness of 8 microns was formed on each test piece surface. The surface layer consisted of (V, Ta)C, and the ratio of V to Ta was about 20 to 1 by weight.

EXAMPLE 4

5 kg of borax were introduced into a crucible made of heat-resistant alloy and heated up to 950° C. in an electric furnace. Then, 1.43 kg (20 percent of the composition) of $Ta_2O_5$ powder (which was not more than 100 mesh) and 0.72 kg of ferro-niobium (Fe-Nb) powder (including about 50 percent of Nb), which was not more than 100 mesh, were added to the borax to prepare a treating bath.

Next, test pieces which had the same form, composition and quality as those used in Example 1 were treated in the same manner as in Example 1.

By this treatment, one uniform surface layer with a thickness of 11 microns was formed on each test piece surface. The surface layer consisted of (Nb, Ta)C, and the ratio of Nb to Ta was about 25 to 1 by weight.

In the preparation of molten treating baths from combinations of components, the borax and/or borate was first heated to bath temperature in a suitable crucible in, e.g., an electric furnace and each element (in metal or alloy form) and each oxide were introduced into the thus-obtained molten borate. However, in order to prepare the molten treating bath, other similar methods can be used. For example, all of the components are alternatively mixed and the mixture is then heated to the molten state. Also, a molten treating bath can be changed to the treating material, e.g., by cooling the bath to its solid state and then pulverizing the solid. The resulting powder can be used as the treating material.

The preceding text amply teaches those having any familiarity with the present art how to practice the described invention to the fullest extent. Numerous apparent variations are readily made without departing from the spirit or scope of the present disclosure.

What is claimed is:

1. A method for forming a mixed-carbide layer of Va-Group elements of the Periodic Table on an article of ferrous alloy, containing at least 0.10 percent by weight of carbon in its composition, which comprises:

immersing the article in a molten treating bath having from 1 to 40 weight percent of at least one oxide of at least one Va-Group element, from 1 to 40 weight percent of at least one metal or alloy of at least one Va-Group element other than any Va-Group element in oxide form and at least one member selected from the group consisting of boric acid and a borate; the percentages being based on the total weight of the molten treating bath; and the weight of Va-Group elements in the metal or alloy being at least 10 percent of the weight of the oxide;

maintaining said article in said molten treating bath to form a mixed-carbide surface layer of Va-Group elements on the article; and removing said article from the molten treating bath.

2. A method according to claim 1 which comprises introducing into the molten bath the oxide and metal or alloy in powder or flake form to form the molten treating bath.

3. A method according to claim 1 wherein the ferrous alloy is a member selected from the group consisting of carbon steel and carbon-containing alloy steel.

4. A method according to claim 1 wherein the borate is at least one member selected from the group consisting of sodium borate and potassium borate.

5. A method according to claim 1 wherein the oxide is at least one member selected from the group consisting of a vanadium oxide, a niobium oxide and a tantalum oxide.

6. A method according to claim 1 wherein the metal is a member selected from the group consisting of a vanadium, niobium and tantalum.

7. A method according to claim 1 wherein the alloy is a member selected from the group consisting of ferro-vanadium, ferro-niobium and ferro-tantalum.

8. A method according to claim 1 wherein the alloy is ferro-niobium, the oxide is a vanadium oxide, and the weight of niobium in the ferro-niobium is not less than 44 percent of the weight of the vanadium oxide.

9. A method according to claim 1 wherein the alloy is ferro-vanadium, the oxide is a niobium oxide, and the weight of vanadium in the ferro-vanadium is not less than 10 percent of the weight of the niobium oxide.

10. A method according to claim 1 wherein the alloy is ferro-vanadium, the oxide is a tantalum oxide, and the weight of vanadium in the ferro-vanadium is not less than 20 percent of the weight of the tantalum oxide.

11. A method according to claim 1 wherein the alloy is ferro-niobium, the oxide is a tantalum oxide, and the weight of niobium in the ferro-niobium is not less than 13 percent of the weight of the tantalum oxide.

12. A method according to claim 1 wherein the oxide and the metal or alloy are initially in powder or flake form.

13. A method for forming a mixed carbide layer of Va-Group elements of the Periodic Table in an article of ferrous alloy, containing at least 0.10 percent by weight of carbon in its composition, which comprises immersing the article in a molten treating bath having a composition corresponding to that of a combination of the following individual initial components:

(a) at least one molten member selected from the group consisting of boric acid and a borate, (b) at least one Va-Group element in oxide form, and (c) at least one different Va-Group element in metal or alloy form, the metal or alloy having a particle size finer than 100 mesh, maintaining said article in the molten treating bath to form a mixed-carbide surface layer of Va-Group elements on the article, and removing said article from the molten treating bath.

14. A method for forming a mixed-carbide layer of Va-Group elements of the Periodic Table on an article of ferrous alloy, containing at least 0.10 percent by weight of carbon in its composition, which comprises preparing a molten treating bath having a composition consisting essentially of:

at least 20 weight percent of at least one member selected from the group consisting of boric acid and a borate which is molten and stable at a temperature within the range of from 850° to 1100° C. and at most 80 percent by weight of a combination of:

(a) at least one oxide of at least one Va-Group element and (b) at least one Va-Group element in metal or alloy form, any Va-Group element in (b) being different from any in (a), immersing the article into the molten treating bath, maintaining said article in said molten treating bath to form a mixed-carbide layer of Va-Group elements on the article, and removing said article from the molten treating bath.

* * * * *